United States Patent [19]

Sugiyama

[11] Patent Number: 4,729,456

[45] Date of Patent: Mar. 8, 1988

[54] ROPE LOCKING DEVICE WITH LOCK DEVICE AND LOCK RELEASE THEREFOR

[75] Inventor: Yutaka Sugiyama, Tokyo, Japan

[73] Assignee: Nihon Biso Kabushiki Kaisha, Tokyo, Japan

[21] Appl. No.: 17,869

[22] Filed: Feb. 24, 1987

[51] Int. Cl.[4] ..... B65H 59/16

[52] U.S. Cl. ..... 188/65.1; 188/180; 188/188

[58] Field of Search ..... 188/65.1, 65.2, 65.3, 188/65.4, 65.5, 180, 189, 184–188; 242/107.3, 107.2; 182/5, 190, 192; 254/267, 408, 378, 379, 391

[56] References Cited

U.S. PATENT DOCUMENTS

| | | | |
|---|---|---|---|
| 4,407,498 | 10/1983 | Clore et al. | 188/65.1 X |
| 4,555,091 | 11/1985 | May et al. | 188/65.1 X |
| 4,632,226 | 12/1986 | Koch | 188/65.1 |
| 4,669,582 | 6/1987 | Sandreid | 188/65.1 |

*Primary Examiner*—Douglas C. Butler

*Attorney, Agent, or Firm*—Hedman, Gibson, Costigan & Hoare

[57] ABSTRACT

A rope locking device for stopping an abnormal descent of an ascending and descending apparatus such as a gondola used for a construction work. The device comprises two separate cases. One of the cases contains a rope clamping member formed on one side thereof with a groove in which one side of a rope can be engaged, a rope clamping member drive for displacing the rope clamping member between a first position in which the rope clamping member is spaced from the rope and a second position in which the rope clamping member is pressed against the rope, an energizing member for energizing the rope clamping member to move from the first position to the second position, a lock device for holding the rope clamping member in the first position against the energizing force and a lock release device for releasing locking of the rope clamping member by detecting a relative running speed of the rope and releasing the lock device when the running speed of the rope has exceeded a predetermined speed. The other case contains a rope support member formed with a groove in which the other side of the rope can be engaged. The device further comprises case fixing assembly or device for fixing the two cases to each other.

6 Claims, 7 Drawing Figures

ROPE LOCKING DEVICE WITH LOCK DEVICE AND LOCK RELEASE THEREFOR

BACKGROUND OF THE INVENTION

This invention relates to a rope locking device and, more particularly, to a rope locking device for stopping an abnormal descent of an ascending and descending apparatus such as a gondola or the like apparatus used for a construction work etc. when such apparatus descends at an abnormally high speed due to a trouble in a winch or other cause.

As a rope locking device for stopping an abnormal descent of a gondola or the like due to a trouble of a winch, there have been known devices as disclosed in Japanese Preliminary Utility Model Publication Nos. 12529/1980 and 189986/1982. In these locking devices, a pair of wedge-shaped members each having a groove which fits with a rope in the inner portion thereof and having a tapered outer surface are disposed symmetrically in a single case, guide blocks are provided outside of these wedge-shaped members which guide blocks are in contact with the tapered surfaces of the wedge-shaped members so as to guide these wedge-shaped members, and an actuating device is also provided to actuate the wedge-shaped members. In emergency, these wedge-shaped members are actuated to clamp the rope from both sides and thereby stop the abnormal descent of the gondola or the like apparatus.

There has recently been proposed a system for operating a gondola or the like ascending and descending apparatus (hereinafter referred simply to as "gondola") in which, for improving safety and stability of the gondola, a rope locking device is mounted not only to a rope suspending the gondola but also to a rope or ropes which are stretched vertically at suitable sites such as either side of the gondola and are used for a work other than suspending the gondola. According to this system, the rope for work other than suspending the gondola is utilized as an auxiliary rope for enhancing safety and stability of the gondola. In carrying out this method, however, the above described prior art rope locking device has been found to have a serious disadvantage. In mounting such prior art locking device to a rope, one end of the rope is inserted from one of two rope insertion openings formed in the top and bottom portions of the case of the locking device and taken out of the other rope insertion openings. When this prior art locking device is used for a rope for suspending a gondola, a free end portion of the rope suspended from a parapet wall hook is inserted through the locking device mounted on the gondola on the ground and thereafter the free end of the rope is connected to a winch provided in the gondola. In this case, no particular disadvantage arises. However, in a case where this rope locking device is used for utilizing a rope used originally for a work other than suspending the gondola as an auxiliary rope for ensuring safety and preventing horizontal sway of the gondola, the rope which has already been fastened firmly to a fastening device placed on the ground by using a rope tightening machine must be released from the fastened state to insert the released free end of the rope through the locking device and then the rope must be fastened to the fastening device again ( because the rope must be stretched tightly for preventing horizontal sway of the gondola). This apparently involves a great deal of extra labor. A great difficulty is particularly felt in such a case as when a work is done while the gondola is moved horizontally from one site to another along a wall surface of a building. It is extremely difficult to mount and dismount the rope locking device in air from one rope to another among ropes stretched vertically and in parallel to each other.

It is, therefore, an object of the invention to provide an improved rope locking device eliminating the above described problem arising in using the prior art rope locking device for the method of operating a gondola utilizing ropes used originally for a work other than suspending the gondola. More specifically, it is an object of the invention to provide a rope locking device which can be mounted to or dismounted from a rope which has already been stretched between the roof of a building and the ground without releasing the rope from a fastened state.

SUMMARY OF THE INVENTION

For achieving the above described object of the invention, the rope locking device according to the invention is characterized in that it comprises two separate cases, one of the cases containing a rope clamping member formed on one side thereof with a groove in which one side of a rope can be engaged, rope clamping member drive means connected to the rope clamping member for displacing the rope clamping member between a first position in which the rope clamping member is spaced from the rope and a second position in which the rope clamping member is pressed against the rope, an energizing member for energizing the rope clamping member drive means to displace the rope clamping member from the first position to the second position, lock means for locking the rope clamping member drive means so as to hold the rope clamping member in the first position against the energizing force imparted by the energizing member, and lock release means for releasing locking of the rope clamping member drive means by the lock means by detecting a relative running speed of the rope and releasing the lock means when the running speed of the rope has exceeded a predetermined speed, and the other of the cases containing a rope support member formed with a groove in which the other side of the rope can be engaged, the rope locking device further comprising case fixing means for fixing the two cases to each other.

According to the invention, it is unnecessary, in attaching the rope locking device to the rope, to insert the rope through the rope locking device from the end portion of the rope. Instead, the rope locking device can be attached to the rope by simple holding any desired portion of the rope between the two separate cases and fixing the two cases to each other. In a normal state, the rope clamping member provided in one of the cases is locked in a position in which the rope clamping member is spaced from the rope while it is subject to the urging force acting towards the position in which it is pressed against the rope so that the rope can run through the rope locking device without restriction. Once the relative running speed of the rope has exceeded a predetermined speed due to disorder of a winch or some other cause, the lock release means is actuated to enable the rope clamping member to be driven to the position in which it is pressed against the rope so that the rope clamping member clamps the rope tightly in association with the rope support member provided in the other case and thereby stops the abnormal descent of the ascending and descending device immediately. Accordingly, the work for attaching the rope locking device to the rope is greatly facilitated.

According to one aspect of the invention, one of the two cases contains movable elements such as the rope clamping member, the rope clamping member drive means and the lock release means which are of a relatively complex and heavy construction and the other case contains only the rope support member. The latter case can be made very light and compact so that, by fixedly securing the former case to the ascending and descending apparatus, a worker has only to carry the latter case which is light and compact so attaching and detaching of the rope locking device becomes very easy. This is particularly advantageous when the rope locking device must be attached and detached from rope to rope when a work is done while a gondola or the like is horizontally moved.

BRIEF DESCRIPTION OF THE DRAWINGS

In the accompanying drawings,

FIGS. 1A and 1B are front elevational views of the rope locking device according to the invention shown in a state in which a case 1B is attached to a case 1A and front plates 2A and 2B are removed, in which FIG. 1A is a view showing a part of structure of the device during normal running of the rope and FIG. 1B is a view showing the same structure during abnormal running of the rope;

DESCRIPTION OF A PREFERRED EMBODIMENT

With reference to the accompanying drawings, a preferred embodiment of the invention will now be described.

The following description will be made, by way of example, with respect to a case in which the rope locking device according to the invention has been applied to the above described auxiliary rope used for enhancing safety and preventing horizontal sway of a gondola. It will, however, be appreciated that the field of application of the rope locking device of the invention is not limited to the gondola.

Figure 2:
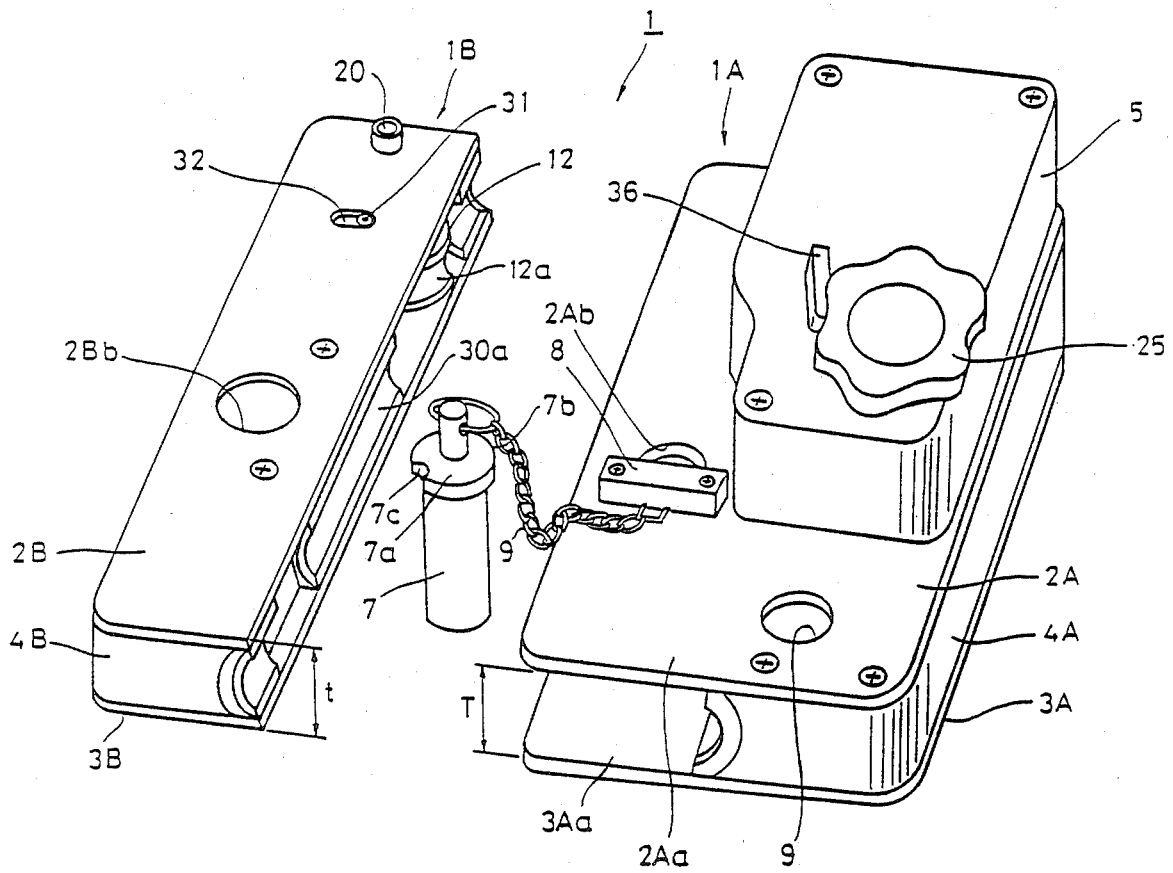
FIG. 2 is a perspective view of the device showing the case 1A and the case 1B in a separated state.

A case 1 housing the rope locking device consists, as shown in FIG. 2, of two separate cases 1A and 1B which are split in a direction in which a rope passes. The case 1A comprises front and rear plates 2A and 3A connected by a side plate 4A and a box-like cover 5 housing engaging means and release means to be described later and mounted on the front plate 2A. The front and rear plates 2A and 3A have flange portions 2A*a* and 3A*a* which extend beyond the position in which the rope is inserted and space for receiving the case 1B is formed between the flange portions 2A and 3A. The case 1B comprises front and rear plates 2B and 3B connected by a side plate 4B. The case 1B is of the same length as the case 1A and of a width which is about the same as the width of the flange portions 2A*a* and 3A*a* of the case 1A. Height t of the case 1B is slightly smaller than interval T between inner surfaces of the front and rear plates 2A and 3A. Thus, the case 1B is formed in a casette shape which is received fitly in the space between the front and rear plates 2A and 3A of the case 1A.

Figure 6:
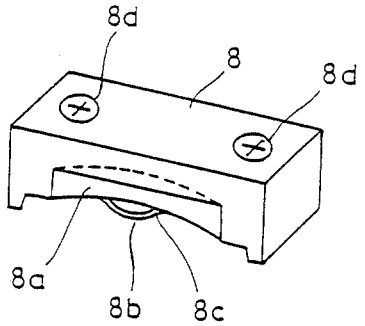
FIG. 6 is an enlarged perspective view of a lock pin engaging member.

A pin 20 is provided on the upper end portion of the case 1B. A recess 6 (FIGS. 3 and 4) in which the pin 20 is engaged is formed in a corresponding portion of the flange portion 2A*a* of the front plate 2A of the case 1A. For fixing the case 1B received in the case 1A, a lock pin 7 is connected to a lock pin engaging member 8 provided on the front plate 2A of the case 1A through a chain 9 and openings 2A*b*, 3A*b*, 4A*b*, 2B*b*, 3B*b* and 30*b* (FIG. 1) are formed respectively in the front and rear plates 2A, 3A of the case 1A, the front and rear plates 2B and 3B of the case 1B and a rope support member 30 to be described later. The lock pin 7 has a disk-like flange portion 7*a* in its upper portion. One side of the flange portion 7*a* is cut off to form a flat surface 7*b* and the other side of the flange portion 7*a* is formed with a recess 7*c*. As shown in FIG. 6, the lock pin engaging member 8 is formed in its lower portion with an arcuate recess 8*a* in which the flange portion 7*a* of the lock pin 7 can be engaged. In a space formed in the bottom portion of the engaging member 8, there is provided a spring 8*c* having a projecting portion 8*b* which can engage in the recess 7*c* of the lock pin 7 and having both ends thereof wound on screws 8*d*, 8*d*. The lock pin 7, lock pin engaging member 8, openings 2A*b*, 3A*b*, 2B*b*, 3B*b* and 30*b*, pin 20 and recess 6 constitute case fixing means for fixing the cases 1A and 1B to each other. The front and rear plates 2A and 3*a* and side plate 4A of the case 1A are formed with openings 9 for mounting the rope locking device to a predetermined position of a gondola (not shown).

Figure 1A:
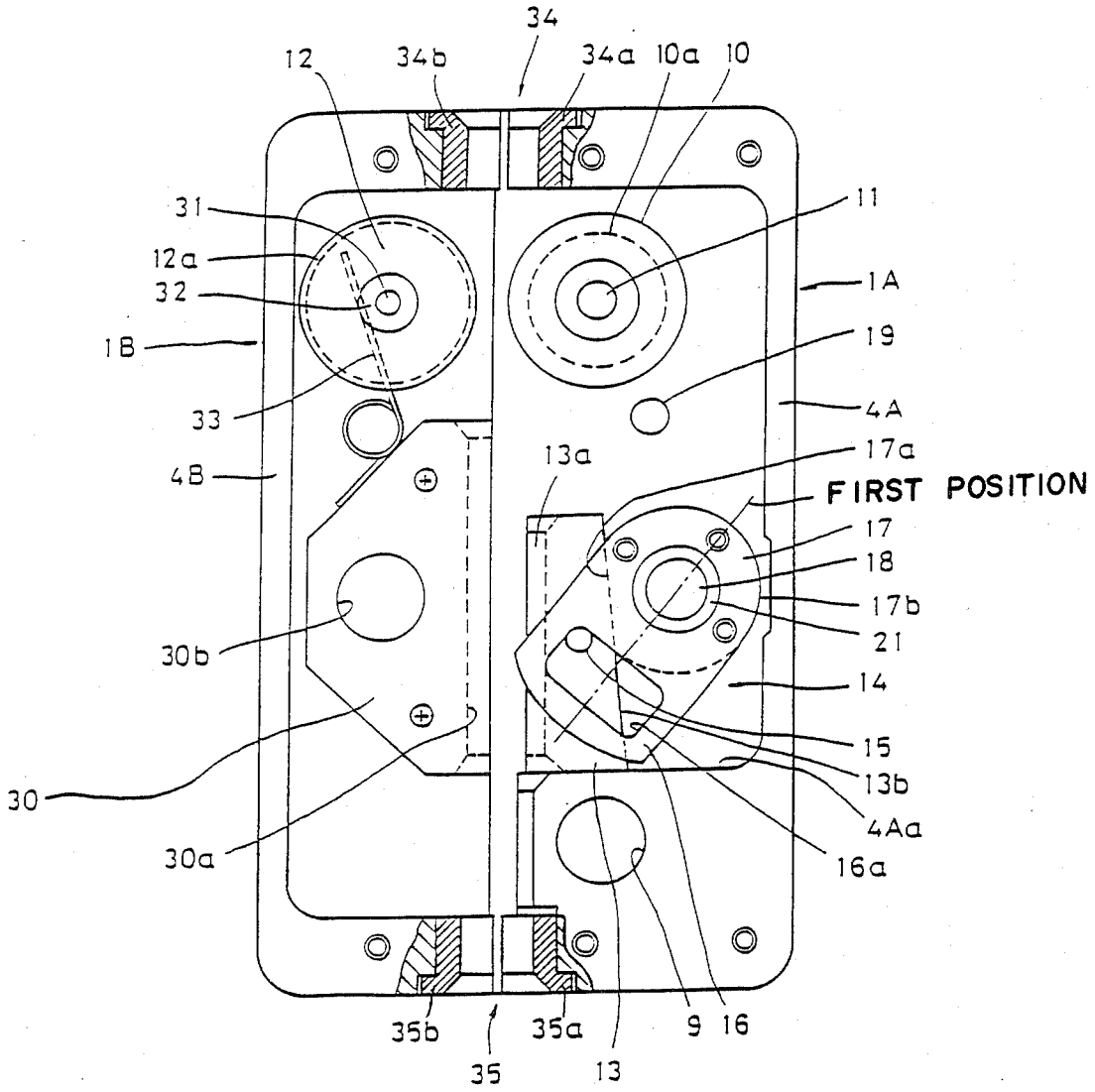
Figure 4:
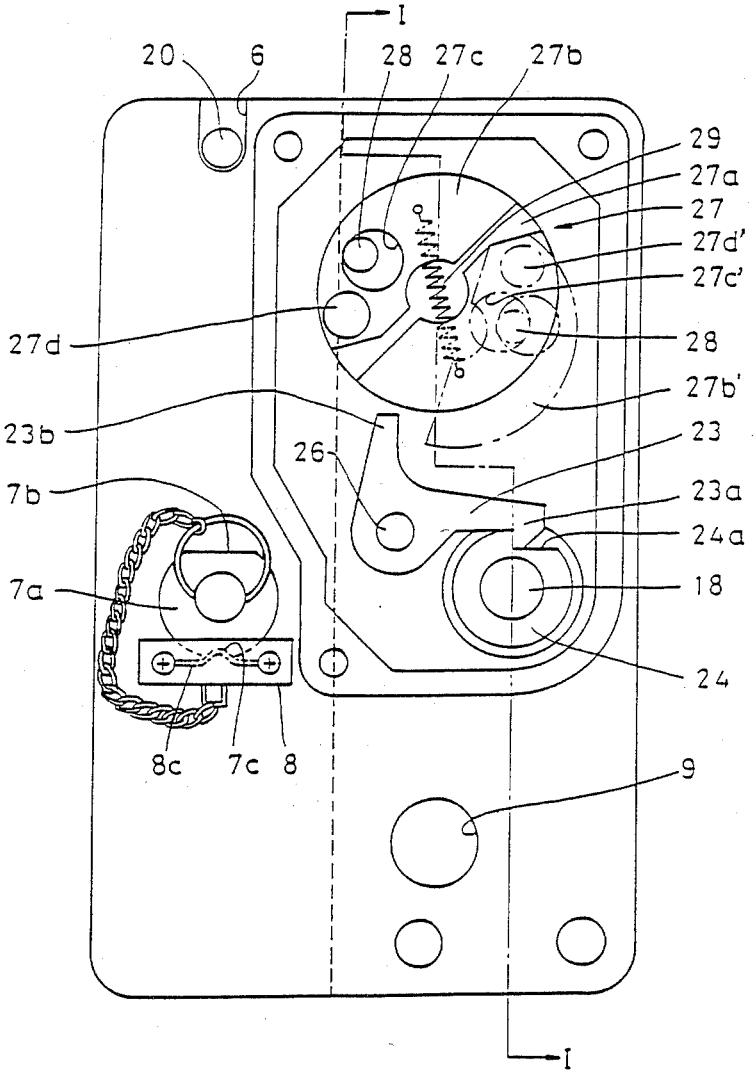
FIG. 4 is a front elevational view of the device in the same state as in FIG. 3 except that a cover 5 has been removed.

Referring mainly to FIG. 1A and FIG. 4, respective elements contained in the cases 1A and 1B will be described. FIGS. 1A and 4 show a state in which the case B has been fitted in the case A and the two cases have been fixed to each other.

Figure 5:
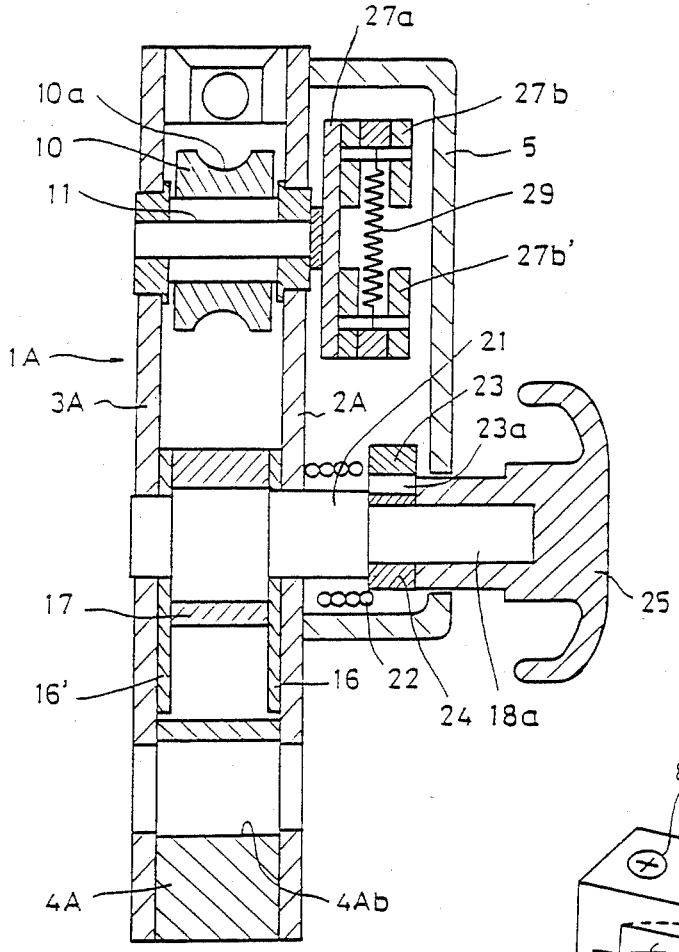
FIG. 5 is a side sectional view taken along lines I—I in FIG. 4.

A guide roller 10 for guiding a rope is rotatably mounted on a shaft extending between the upper portions of the front and rear plates 2A and 3A. The guide roller 10 constitutes a pair of rollers with a guide roller 11 provided on the case 1B as will be described later. The guide roller 10 is formed with a groove 10*a* (FIG. 5) in which one side of the rope can be engaged. The guide roller 10 concurrently has a function of a drive roller for driving a governor to be described later.

In space of the case 1A below the guide roller 10, there are provided a wedge-shaped member 13 constituting a rope clamping member and rope clamping member drive means 14 which is coupled to the wedge-shaped member 13 and is capable of displacing the member 13 between two predetermined positions. The wedge-shaped member 13 is formed on its side facing the rope with a groove 13*a* in which one side of the rope can be engaged and, on the opposite side, with a tapered surface 13*b* which is inclined towards the side of the rope. Engaging pins 15 are provided on both sides of the middle portion of the wedge-shaped member 13.

The rope clamping member drive means 14 comprises, in the present embodiment, the engaging pins 15, a pair of levers 16, 16′ (FIG. 5) formed with slots 16*a*, 16*a*′ in which these engaging pins 15 are engaged and disposed with a spaced relationship to each other so as to hold the wedge-shaped member 13 therebetween, and a cam 17 which is formed integrally with the lever portions 16, 16' and is in abutting engagement with the tapered surface 13*b* of the wedge-shaped member 13. The cam 17 is generally of a columnar configuration with an arcuate surface 17*b* and a flat surface 17*a*. The cam 17 and the levers 16, 16' are secured to a pin 18 which extends rotatably between the front and rear plates 2A and 3A. In a first position (i.e., the lowermost position) shown in FIG. 1A, the wedge-shaped member 13 has its engaging pins 15, 15 engaged in one corners of the clots 16*a*, 16*a'* of the levers 16, 16', the flat surface 17*a* of the cam 17 is in abutting engagement with the upper portion of the tapered surface 13*b* of the wedge-shaped member 13 and the bottom surface of the wedge-shaped member 13 is in abutting engagement with a bottom surface 4A*a* of the side plate 4A of the case 1A. In this position, the wedge-shaped member 13 is spaced by the greatest distance from the rope inserted through the rope locking device and the rope can freely run through the rope locking device.

Figure 1B:
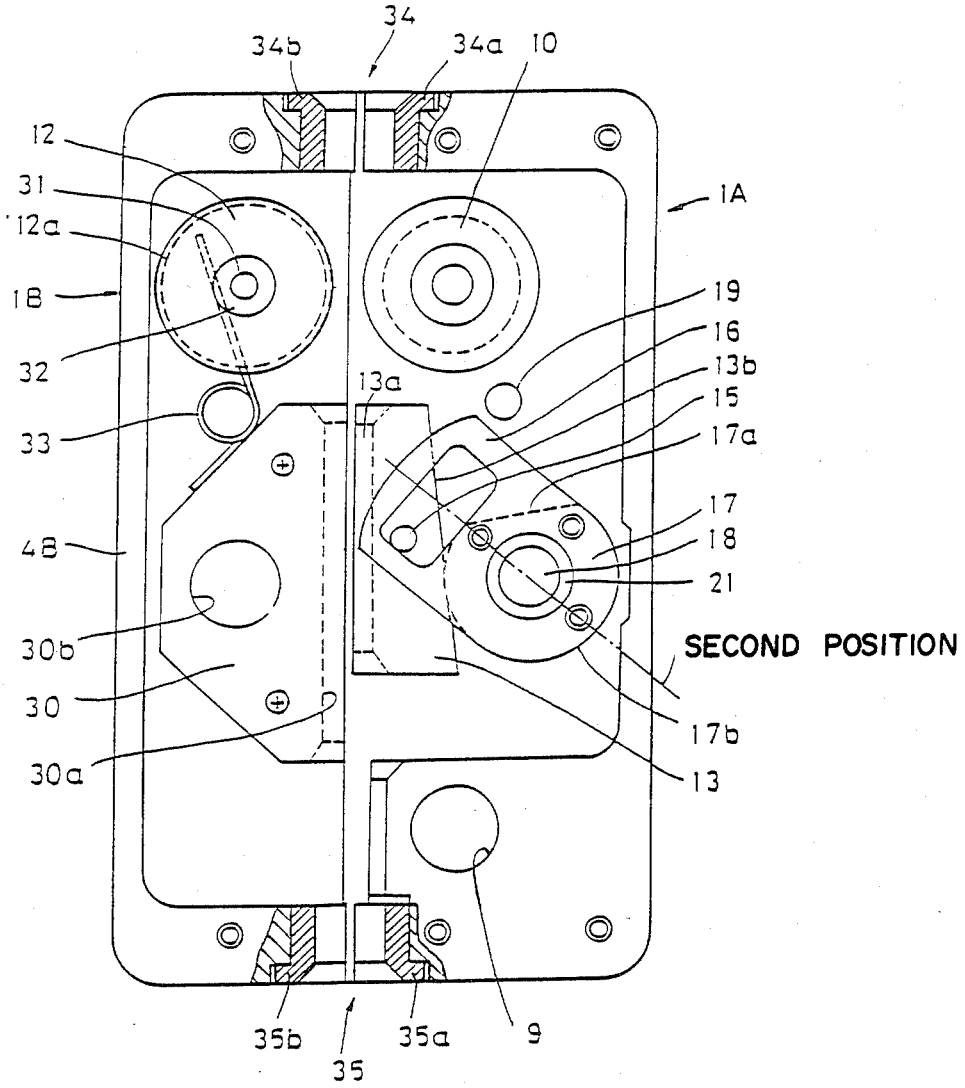

In a second position shown in FIG. 1B (i.e., the uppermost position) in which the cam 17 has been rotated by about 90 degrees in the clockwise direction from the position shown in FIG. 1A, the engaging pins 15, 15 of the wedge-shaped member 13 are engaged in corners of the openings 16*a*, 16*a'* opposite to the corners shown in FIG. 1A and the arcuate surface 17*b* of the cam 17 is in abutting engagement with the lower portion of the tapered surface 13*b* of the wedge-shaped member 13. In this position, the wedge-shaped member 13 is in pressed engagement with the rope to clamp the rope and thereby to stop running of the rope (i.e., descending of the gondola) quickly. Reference character 19 designates a stop provided for restricting the clockwise rotation of the rope clamping member drive means 14.

A part of a projecting portion 21 of the pin 18 of the rope engaging member drive means 14 projects forwardly from the front plate 2A and a coil spring 22 (FIG. 5) is provided about the projecting portion 21. This coil spring 22 constitutes an energizing member for constantly energizing the rope clamping member drive means 14 in the direction in which the wedge-shaped member 13 is displaced from the first position to the second position (i.e., clockwise direction).

Figure 3:
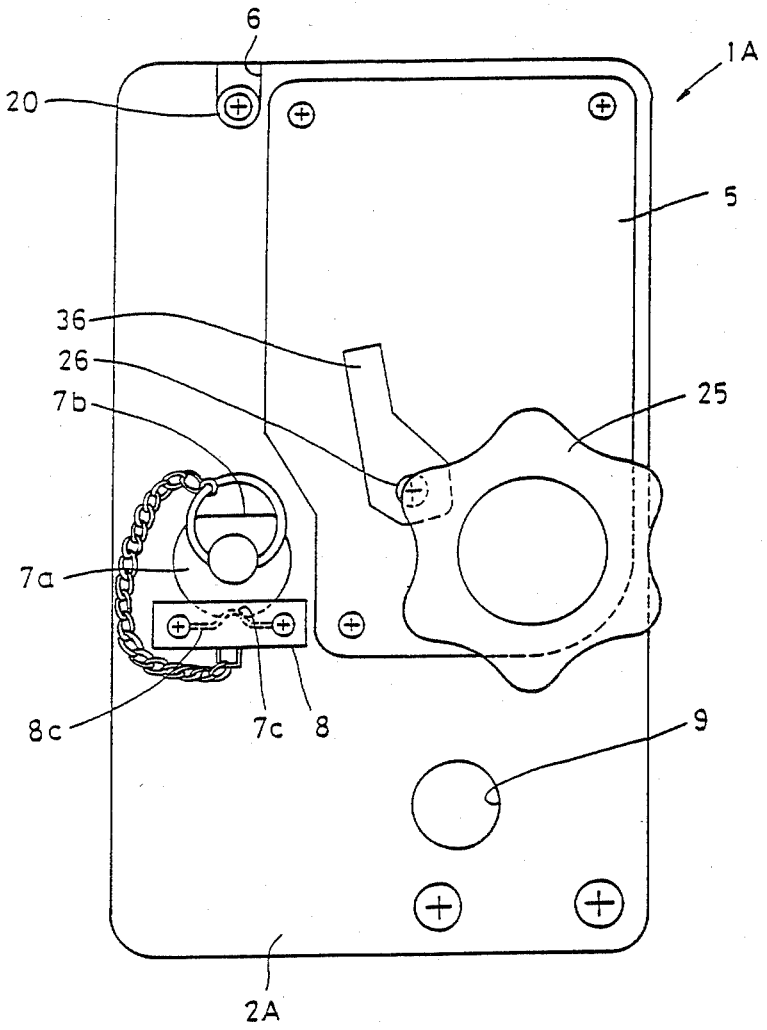
FIG. 3 is a front elevational view showing the device in a state in which the case 1B is attached to the case 1A.

A cam 24 is secured to a projecting portion 18*a* of the pin 18. In the state shown in FIG. 1A, a pawl 23*a* of a trigger 23 pivotably mounted to the front plate 2A through a pin 26 is engaged in a recess 24*a* of the cam 24 (FIG. 4). The trigger 23 is urged by a spring (not shown) in a clockwise direction so that the pawl 23a falls in the recess 24*a*. Accordingly, the cam 24 and the trigger 23 constitute lock means for locking the rope clamping member drive means 14 thereby to hold the wedge-shaped member 13 in the first position against the urging force excercised by the coil spring 22. To the upper end portion of the pin 26 projecting from the cover 5 is attached a manual lever 36 (FIG. 3). For conducting a test or causing the rope to be locked at a desired position, the rope can be released from the locked state by manipulating the manual lever 36.

Lock release means for releasing locking by the lock means (23, 24) by detecting a relative running speed of the rope and actuating the lock means when the detected speed has exceeded a predetermined speed consists of a governor 27 and an arm 23*b* of the trigger 23 which arm can be struck by pawls 27*b*, 27*b'* of this governor 27. The governor 27 comprises a base plate 27*a* (FIG. 5) secured to an end portion of the shaft 11 of the guide roller 10 and the pair of semicircular pawls 27*b*, 27*b'* disposed on the surface of the base plate 27*a* in such a manner that these pawls 27*b* and 27*b'* diametrically oppose each other. These pawls 27*b*, 27*b'* are pivotably mounted on the base plate 27*a* by means of pins 27*d*, 27*d'* and are formed with openings 27*c*, 27*c'*. Pins 28 secured to the base plate 27*a* engage in these openings 27*c*, 27*c'* thereby restricting the movement of the pawls 27*b*, 27*b'*. A spring 29 is provided between the pawls 27*b*, 27*b'* so that the pawls 27*b*, 27*b'* are normally held in a state in which they do not move outside of the periphery of the base plate 27*a*.

A handle 25 is connected to the projecting portion 18*a* of the pin 18 of the rope clamping member drive means 14. By turning the handle 25 manually in a counterclockwise direction when the rope clamping member drive means 14 is in the position shown in FIG. 1B and the pawl 23*a* of the trigger 23 is released from the recess 24*a* of the cam 24, the rope clamping member drive means 14 is restored to the position shown in FIG. 1A and the pawl 23*a* of the trigger 23 engages in the recess 24*a* thereby locking the drive means 14.

Referring to FIG. 1A and FIG. 2 again, the elements contained in the case 1B will be described. As will be apparent from the foregoing description, the case 1A is a part of the rope locking device secured fixedly to the gondola and all movable members of a relatively complex and heavy construction including the wedge-shaped member 13 are housed in the case 1A. In comparison, the case 1B which is carried by a worker as required is devised to contain minimum necessary elements, housing of movable elements of a complex and heavy construction being avoided as far as possible. More specifically, the case 1B contains only the guide roller 12 which constitutes a pair of guide rollers with the guide roller 10 and a rope support member 30 which is secured to the case 1B for clamping the rope in association with the wedge-shaped member 13.

The guide roller 12 has a groove 12*a* in which the other side of the rope is engaged. The shaft 31 of the guide roller 12 is engaged in slots 32 formed in the lateral direction in the front and rear plates 2B, 3B. An end portion of a coil spring 33 is in abutting engagement with an inclined surface of the rope support member 30 and the other end portion of the coil spring 33 is in abutting engagement with a side surface of a sleeve 32 fitted on the shaft 31 thereby urging the guide roller 12 towards the rope.

The rope support member 30 is secured between the front and rear plates 2B and 3B and is formed on the side facing the rope with a groove 30*a* in which the rope can be engaged.

Rope insertion opening forming members 34*a*, 34*b* and 35*a*, 35*b* of semicylindrical configuration are secured to the upper and lower portions of the cases 1A and 1B so that these members form rope insertion openings 34 and 35 respectively when the case 1B is attached to the case 1A.

The operation of the above described embodiment will now be described. For attaching the rope locking device to the rope, the case 1B is separated from the case 1A to the state as shown in FIG. 2 (the case 1A is fixedly secured to a predetermined location of the gondola). After applying the case 1A to one side of the rope, the case 1B is attached to the case 1A with the pin 20 being caused to engage in the recess 6. The lock pin 7 is inserted through the respective insertion openings in such a manner that the flat surface 7*b* of the flange 7*a* faces the engaging member 8. Then, the lock pin 7 is rotated to cause the projecting portion 8*b* of the spring 8*c* to engage in the recess 7*c* thereby fixing the cases 1A and 1B to each other. The rope thereby is caused to extend between the insertion openings 34 and 35 and to be clamped between the guide rollers 10 and 12. At this time, the wedge-shaped member 13 and the rope clamping member dirve means 14 are in the positions shown in FIG. 1A, the lock means 23, 24 is in the position shown in FIG. 4 and the pawls 27*b*, 27*b*' of the governor 27 of the lock release means are in the position shown by the solid line in FIG. 4.

This state is maintained in a normal condition and the rope can run through the rope locking device without restriction. Once, however, the gondola starts an abnormal descent at a high speed due to disorder in the winch or some other cause, the guide rollers 10 and 12 are rotated at a high speed and free end portions of the pawls 27*b*, 27*b*' of the governor 27 which is rotated with the guide rollers 10 and 12 project outwardly of the periphery of the base plate 27*a* against the force of the spring 29 due to centrifugal force acting thereon and strike the arm 23*b* of the trigger 23. The trigger 23 thereby is rotated in the counterclockwise direction and the pawl 23*a* of the trigger 23 is disengaged from the recess 24*a* of the cam 24. Thereupon the cam 17 and the levers 16, 16' of the rope clamping member drive means 14 which are constantly urged in the clockwise direction by the coil spring 22 are rotated clockwise from the position shown in FIG. 1A to the position shown in FIG. 1B. The positions of the pins 15, 15 in the slots 16*a*, 16*a*' of the levers 16, 16' are changed from those shown in FIG. 1A to the opposite positions in the slots 16*a*, 16*a*' and the wedge-shaped member 13 is pushed up by the levers 16, 16' with the tapered surface 13*b* being in sliding engagement with the arcuate surface 17*b* of the cam 17, moving from the first position shown in FIG. 1A to the second position shown in FIG. 1B in which the wedge-shaped member 13 is pressed against the rope. The rope therefore is clamped between the wedge-shaped member 13 and the rope support member 30 to stop the abnormal descent of the gondola.

In a case where it is desired to release the clamping of the rope by the wedge-shaped member 13 and the rope support member 30, the handle 25 is manually rotated in the counterclockwise direction against the force of the coil spring 22 and the wedge-shaped member 13 and the drive means 14 are reset to the state shown in FIG. 1A and the lock means is reset to the state shown in FIG. 4 respectively.

In the above described embodiment, the rope clamping member is constructed in the form of the wedge-shaped member 13. The shape of the rope clamping member however is not limited to the wedge-shape. For example, a rope clamping member of a rectangular shape may be used if the shapes of the cam 17 and the slots 16*a*, 16*a*' of the levers 16, 16' are suitably selected. The rope clamping member drive means 14, lock means 23, 24, lock release means 27, 23*b*, rope support member 30 and case fixing means also are not limited to the above described construction but various other designs may be adopted within the scope and spirit of the invention.

For preventing burning of the surface of the wedge-shaped member 13 and the rope support member 30 contacting the rope, a layer of suitable heat-resisting material such as molybdenum oxide ceramic may be provided on thse surfaces.

The foregoing description has been made on the assumption that the rope locking device is attached to an auxiliary rope for enhancing safety and preventing horizontal sway of a gondola. Field of application of the rope locking device according to the invention is not limited to this but the device may be attached, for example, to a rope suspending a gondola, work cage, cradle platform or other ascending and descending apparatus for preventing abnormal descent of such apparatus.

What is claimed is:

1. A rope locking device comprising two separate cases, one of said cases containing:

a rope clamping member formed on one side thereof with a groove in which one side of a rope can be engaged;

rope clamping member drive means connected to said rope clamping member for displacing said rope clamping member between a first position in which said rope clamping member is spaced from the rope and a second position in which said rope clamping member is pressed against the rope;

an energizing member for energizing said rope clamping member drive means to displace said rope clamping member from the first position to the second position;

lock means for locking said rope clamping member drive means so as to hold said rope clamping member in the first position against the energizing force imparted by said energizing member; and lock release means for releasing locking of said rope clamping member drive means by said lock means by detecting a relative running speed of the rope and releasing said lock means when the running speed of the rope has exceeded a predetermined speed, and the other of said cases containing a rope support member formed with a groove in which the other side of the rope can be engaged, said rope locking device further comprising case fixing means for fixing said two cases to each other.

2. A rope locking device as defined in claim 1 which further comprises reset means capable of actuating said rope clamping member drive means by an operation performed outside of said rope locking device for displacing said rope clamping member from the second position to the first position.

3. A rope locking device as defined in claim 1 wherein said one of the cases has front and rear plates which extend beyond a position in which the rope is inserted and define a space therebetween and said other case is formed as a cassette which is fitted in said space.

4. A rope locking device as defined in claim 1 wherein said rope clamping member drive means comprises pins provided on said rope clamping member, levers formed with slots in which said pins can engage and a cam formed integrally with said levers and being in abutting engagement with a side of said rope clamping member opposite to the side on which the groove for engaging with the rope is formed.

5. A rope locking device as defined in claim 4 wherein said rope clamping member is a wedge-shaped member whose side opposite to the side on which the groove for engaging with the rope is formed is formed as a tapered surface inclining towards the rope from said first position to said second position.

6. A rope locking device as defined in claim 1 wherein said one of the cases is adapted to be secured to an ascending and descending device and said other case is a portable case.

* * * * *